US005658111A

United States Patent [19]

Rathert

[11] Patent Number: 5,658,111

[45] Date of Patent: Aug. 19, 1997

[54] APPARATUS FOR ROUNDING THE SPINES OF BOOK BLOCKS

[75] Inventor: Horst Rathert, Minden, Germany

[73] Assignee: Kolbus GmbH & Co. KG, Rahden, Germany

[21] Appl. No.: 518,301

[22] Filed: Aug. 23, 1995

Related U.S. Application Data

[63] Continuation of Ser. No. 210,309, Mar. 17, 1994, abandoned.

[30] Foreign Application Priority Data

Mar. 18, 1993 [DE] Germany ..... 43 08 602.0
Sep. 10, 1993 [DE] Germany ..... 43 30 719.1

[51] Int. Cl.[6] ..... B42C 5/02
[52] U.S. Cl. ..... 412/30
[58] Field of Search ..... 412/25, 30

[56] References Cited

U.S. PATENT DOCUMENTS

| | | | |
|---|---|---|---|
| 1,864,557 | 6/1932 | Schramm | 412/30 |
| 3,413,669 | 12/1968 | Thorp | 412/30 X |
| 4,747,740 | 5/1988 | Rahe | 412/30 X |
| 5,104,275 | 4/1992 | Rathert | 412/30 X |
| 5,114,293 | 5/1992 | Rathert | 412/30 |

FOREIGN PATENT DOCUMENTS

| | | | |
|---|---|---|---|
| 12 23 338 | 3/1962 | Germany . | |
| 40 05 948 A1 | 8/1991 | Germany . | |
| 485013 | 9/1975 | U.S.S.R. | 412/30 |

*Primary Examiner*—S. Thomas Hughes
*Attorney, Agent, or Firm*—Chilton, Alix & Van Kirk

[57] ABSTRACT

Apparatus for rounding the spines of book blocks comprises rounding elements that act on the sides of the book block, the action of these rounding elements being due to a defined rotation and pressure, the rounding elements consisting of rounding segments which are drive-rotated by actuating mechanisms and can be moved vertically to thereby execute rolling movements on the sides of the book block. The vertical movement of said rounding segments are superimposed on their rotation in a manner such as to compensate for the vertical movement of the book block generated as a consequence of the rotation.

23 Claims, 3 Drawing Sheets

APPARATUS FOR ROUNDING THE SPINES OF BOOK BLOCKS

This is a continuation of application(s) Ser. No. 08/210,309 filed on Mar. 17, 1994, now abandoned.

BACKGROUND OF THE INVENTION

1. Field of the Invention

The present invention relates to the shaping of partially completed books and particularly to rounding the spines of book blocks. More specifically, this invention is directed to spine-rounding apparatus which acts from the opposite sides of a book block to controllably apply pressure thereto and especially to the exercise of control over book block spine rounding elements so as to cause such elements to execute rolling movements on the sides of a book block. Accordingly, the general objects of the present invention are to provide novel and improved methods and apparatus of such character.

2. Description of the Prior Art

The spine-rounding of book blocks is an operation performed in the course of book manufacture. The spine-rounding operation causes the book block spine to assume the desired shape for subsequent binding while, at the same time, a complementary shape is imparted to the cut fore edge of the block. The conventional technique for spine-rounding implements what is known in the trade as the roller-rounding principle.

During roller-rounding, the individual leaves or printed sheets which comprise the book block are smoothly and progressively displaced relative to one another as a result of the simultaneous rolling movement of grooved rounding rollers on the book block opposite sides. This rolling movement is caused to progress through a defined rotation angle concurrently with the application of pressure so that, as the book block passes through the rounding rollers, the leaves or printed sheets are pushed progressively further forward in the direction of the block center. The rounding operation should result in the book block spine being configured as an arc of a circle or a somewhat flattened arc. This shaping is critically important in order to provide the desired book block spine profile and to permit the performance of the subsequent book block backing or binding operation. Restated, in the course of manufacture of a book, the spine of a book block must be formed into a rounded shape with the degree of rounding being determined by a rounding coefficient which is a function of the spine arc and the book block thickness. When the roller-rounding principle is applied, the spine shape is primarily influenced by the pressure exerted by the rounding rollers, the angle through which the rollers rotate and the diameter of the rounding rollers. The spine shape is also influenced, to a lesser degree, by other factors.

In prior art book block shaping machines which implement the roller-rounding principle, a rounding roller with a single diameter is employed for all sizes of book block. Accordingly, bearing in mind the above-listed principle factors which influence a roller-rounding process, it is inevitable that a single diameter roller will be able to satisfy the manufacturing requirements to only a limited extent. Restated, the desired spine rounding, in the shape of an arc of a circle, can be achieved only when the roller diameter and the book block thickness are matched to one another. When small format book blocks are shaped, the gross mismatch between the rounding roller diameter and the book block thickness produces the condition where an effective rounding stroke, as required for the desired rounding result, cannot be achieved. Conversely, when large-format book blocks are to be shaped, the relatively small-diameter rounding roller is incapable of exerting the requisite pressure forces on the central portion of the book block to produce the requisite leaf displacement.

SUMMARY OF THE INVENTION

The present invention overcomes the above-briefly discussed and other deficiencies and disadvantages of the prior art and, in so doing, provides a novel and improved technique for rounding the spines of book blocks. The invention also encompasses apparatus for implementing this novel technique and particularly apparatus which achieves acceptable-quality insofar as the shaping of a book block is concerned, regardless of book block thickness. Apparatus in accordance with the invention also enables the shape of the spine of a book block to be varied as desired.

The apparatus of the present invention comprises rounding elements which are caused to both rotate and move along the book block sides so as to execute rolling movements on the sides. The movement of the rounding elements along the sides, typically vertical movement, is superimposed on the rotational motion in a manner such as to compensate for vertical movement of the book block produced as a consequence of the rotational movement of the rounding elements. Additionally, the radius of the ronnding elements may be varied with book block thickness to optimize the process.

With the spine-rounding apparatus of the invention, it is possible to apply pressure forces of any desired magnitude to a book block being shaped. This results in significantly improved rounding even in cases involving small format book blocks. Furthermore, the use of different rounding radii enables the rounding effect to be achieved in the optimum manner.

BRIEF DESCRIPTION OF THE DRAWING

The present invention may be better understood and its numerous objects and advantages will become apparent to those skilled in the art by reference to the accompanying drawings wherein like elements are referred to by like numerals in the various figures and in which.

DESCRIPTION OF THE DISCLOSED EMBODIMENTS

As discussed above, the conventional prior art technique of rounding the spine region of a book block utilizes rounding rollers which execute rolling movements on both side surfaces of the block. The prior art rolling movements result in a rounding effect that is dependent upon roller diameter and the angle through which the rollers rotate while in contact with the book block.

Figure 1:
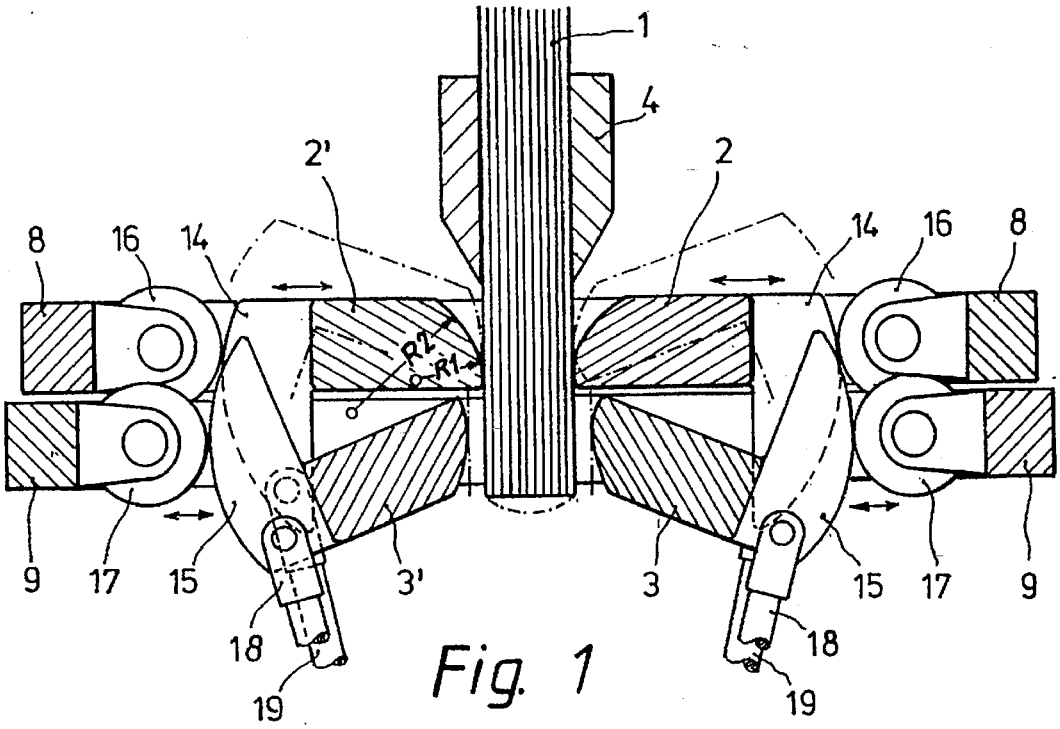
FIG. 1 Is a partial, cross-sectional, side elevation view of spine-rounding apparatus in accordance with a first embodiment of the invention, FIG. 1 being a view taken along line A–B of FIG. 3.
Figure 2:
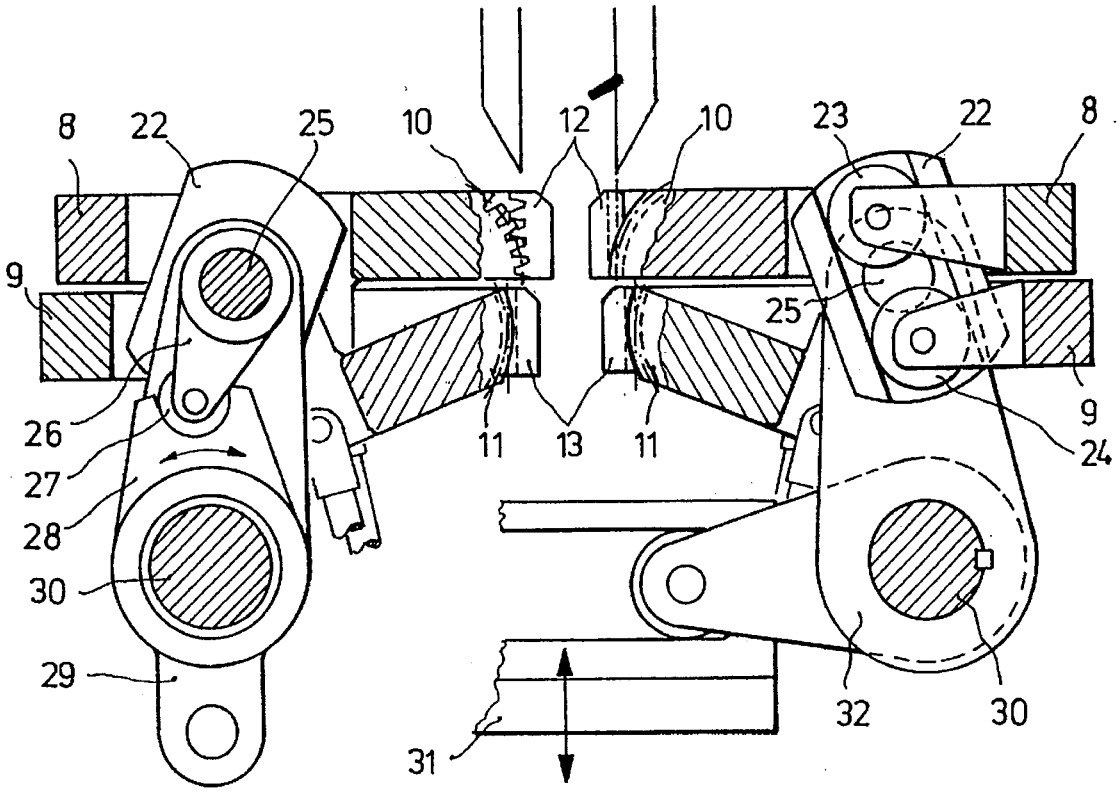
FIG. 2 is a view similar to FIG. 1 taken along line C–D of FIG. 3.
Figure 3:
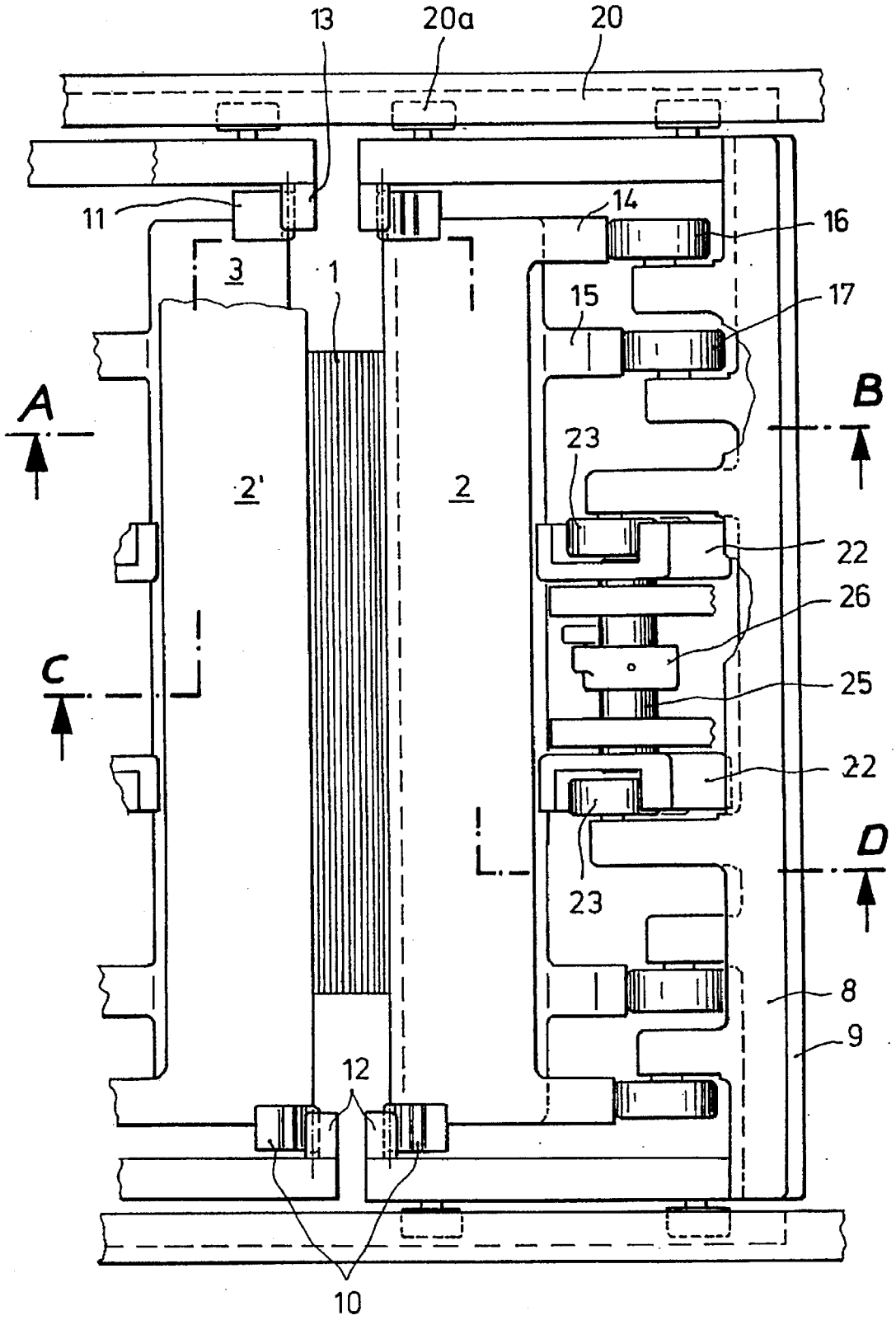
FIG. 3 is a top plan view of apparatus in accordance with the first embodiment of the invention.

In accordance with a first embodiment of the present invention, as depicted in FIGS. 1–3, a pair of rotatable rounding segments 2,3 and 2',3' are provided on each side of the book block 1. These rounding segments are caused to alternately execute repeated rolling movements, characterized by short rounding strokes, on the book block sides. The rounding segments are caused to move upwardly relative to the book block 1 during these rounding strokes. The rounding strokes begin once the block has been released by the clamp 4 of the transport system which delivers the block to the rounding station. Also in accordance with the invention, in order to prevent the inherent resiliency of the book block from causing the block to spring back, the alternating movements of the rounding segments 2, 2', 3, 3' are controlled such that, cooperating in pairs, the rounding segments keep the book block 1 continuously clamped.

Since the rounding effect achieved through use of the apparatus of FIGS. 1–3 results from the summation of multiple individual rounding strokes, and extremely short rounding strokes can optimally be employed when book blocks having a small format are being rounded, the rounding effect can be maximized regardless of the space between the rounding segments while at the same time keeping the book block joint edge at a constant height. The functionally effective area of the rounding segments 2, 2', 3, 3' is preferably divided into two arcuate rolling contact zones, each zone having a different rounding radii as indicated at R1 and R2. These rolling contact zones are selectively employed as a function of the rounding curve shape required for the particular book block being worked.

The rounding segments are supported in the manner to be described below, from translatable intermediate frames, the segments 2, 2' being associated with the frames 8 and the segments 3, 3' being associated with the frames 9. The rounding segments are mounted such that each of the rounding radii R1 and R2, faces a cooperating segment with the same radius in mirror-image fashion on both the same side and on the opposite side of the book block. As may be seen from joint consideration of FIGS. 2 and 3, at their opposite ends the rounding segments are provided with front-located gear portions 10,11 which respectively engage racks 12, 13. The racks 12, 13 are associated with respective intermediate frames 8, 9. The rounding segments are also respectively provided with rearwardly disposed cam projections 14, 15 which bear against respective rollers 16, 17. The rollers 16, 17 are also associated with respective of the intermediate frames 8, 9.

Actuating rods 18, which are driven by means not shown in the drawing, act on the rearwardly disposed portions of each of rounding segments 3, 3' to cause the rounding segments to move vertically. Similar actuating rods 19 are provided for each of rounding segments 2, 2'. The vertical movements of the rear portions of the rounding segments cause the gear portions or segments 10, 11 to execute rolling movements on the racks 12, 13. These rolling movements cause a selected rounding radius, i.e., a contact zone having a radius R1 or R2, to execute a rolling movement against the side of the book block 1. The pitch circle radius of the gear portions 10, 11 corresponds to the mean rounding radius and, accordingly, the outer sheets of the book block 1 will be maintained at a constant height during the rolling movements.

The rounding radius R1, R2 to be employed may be selected by adjusting the vertical stroke of the rounding segments, the vertical stroke being generated by the action of the actuating rods, 18, 19 as discussed above.

The rounding segments are supported from, and horizontally movable relative to, a supporting frame 20 (FIG. 3) via the intermediate frames 8,9. The intermediate frames 8, 9 are coupled to frame 20 via rollers 20*a*. The intermediate frames 8, 9 also support drive rollers 23, 24 which are engaged by slotted links 22. The slotted links are mounted on shafts 25 which, as may be seen from the left-hand representation in FIG. 2, execute an alternating rotation about axles 30. The mechanical coupling between axles 30 and the shafts 25 is in the form of a drive arrangement including arm 26, roller 27, arm 28 and arm 29. Imparting reciprocating motion to arm 29 will cause movement of the links 22 and generate opposing movements of the intermediate frames 8, 9, and thus of the rounding segments, relative to the supporting frame 20. These horizontal movements will be coordinated with the vertical stroke of the rounding segments.

In order to generate the pressure required for the rounding operation, and to apply that pressure to the sides of the book block 1, the rounding segments are moved laterally. This lateral movement is accomplished through the agency of a spring, not shown in the drawing, which exerts a pulling force on a cross beam 31. The cross beam 31 is functionally coupled to the axles 30 via force transmitting levers 32, only one of which is shown.

When a rounding operation has been completed, the book block 1 is released by the rounding segments and a following book block which is to be rounded is acquired. The release operation requires application of a force component which opposes the resilient pulling force applied to the cross beam 31. This opposing force component produces a defined clearance between the rounding segments and the sides of the book block.

Figure 4:
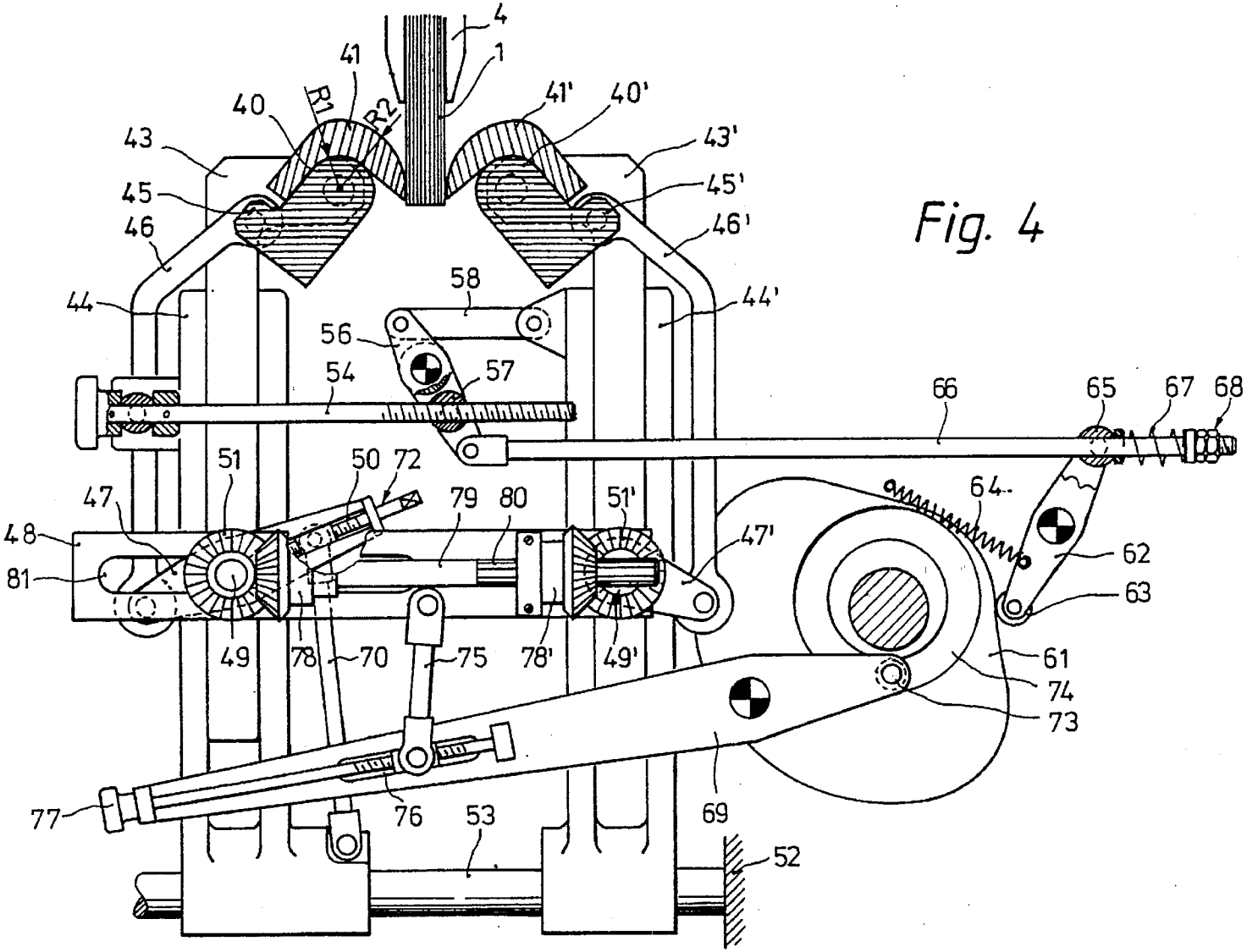
FIG. 4 is a cross-sectional side elevation view of apparatus in accordance with a second embodiment of the invention.

A second embodiment of the present invention is depicted in FIG. 4. The spine-rounding apparatus of the FIG. 4 embodiment employs rounding segments 40, 40', 41 and 41' which act on opposite sides of a book block 1 as may be seen from the drawing. As in the case of the embodiment of FIGS. 1–3, the rounding segments execute rolling movements on the sides of the book block while simultaneously moving upwardly, the rolling movements being initiated when the book block being shaped has been released from the clamp 4 of the feed transport. The vertical movements of the rounding segments 40, 41 and 40', 41' is superimposed on their rotation and, accordingly, compensates for the tendency of the book block to move vertically during shaping. Accordingly, as in the above-described embodiment, the outside sheets or printed pages of the book block 1 will be maintained at a constant level during a spine rounding operation performed with the apparatus of FIG. 4. The holding of the book block 1 at a defined elevation, as a result of the compensating movement imparted to the rounding segments, this elevation being defined by the transport system clamps 4, provides a very significant procedural advantage insofar as the performance of the manufacturing steps subsequent to spine rounding are concerned.

In order to prevent the rounded book block from "springing back" toward its initial shape, the opening and closing movements of the two cooperating rounding segments are synchronized with the opening and closing movements of the transport system clamps in a manner such that book block 1 is clamped at all times.

As may be seen from FIG. 4, the rounding segments 40, 40' and 41, 41' are provided with different rounding radii R1, R2. The rounding radii which is used on a given book block will, of course, be determined by the rounding curve shape required. In order to permit selection of the rounding radius, the larger-radius rounding segments 41, 41' are removably coupled to the smaller radius segments by means, not shown. Thus, rather than selectively adjusting the position of rounding segments to bring a rounding segment contact zone having the appropriate radius into contact with the book block, in the FIG. 4 embodiment the rounding segments are configured as necessary by removal or reinstallation of the segments 41, 41'.

As in the embodiment of FIGS. 1–3, the rounding segments of the FIG. 4 embodiment are supported so as to face one another in mirror-image fashion. The rounding segments are rotatably mounted from respective support members 43, 43'. The support members 43, 43', in turn, are movable in vertical planes in guideways defined by respective vertical guide members 44, 44'.

The first ends of cranked pressure levers 46, 46' are pivotally coupled to respective projections 45, 45' which are integral with the ends of rounding segments 40, 40' which are disposed outwardly with respect to the book contacting portions thereof. The opposite ends of the cranked levers 46, 46' are respectively pivotally coupled to actuating levers 47, 47'.

The vertically movable support members 43, 43' are interconnected via a cross member 48. This interconnection is achieved through axles 49, 49', rotatably mounted in respective support members 43, 43', which extend through the cross member 48. Bevel gears 51, 51' are respectively mounted on axles 49, 49'. The actuating levers 47, 47' are also mounted on respective of axles 49, 49'. The levers 47, 47' and gears 51, 51' are coupled to their respective axles in such a manner as to prevent rotation of the levers and gears relative to the axles.

The guide members 44, 44' are slidably mounted on a horizontal shaft 53. Shaft 53, in turn, is supported from the machine frame 52. The spacing between the rounding segment support members 43, 43' is adjustable by varying the distance between the guide members 44, 44' through the use of a manually operable adjusting spindle 54. Spindle 54, at a first end, is affixed to guide member 44. The second threaded end of spindle 54 engages a threaded bushing 57 which is rotatably mounted in a lever 56. A first end of lever 56, for the reasons to be described below, is coupled to the first end of an actuating rod 66. The second end of lever 56 is connected, via a link 58, to the second guide member 44'.

The opening and closing movements of the rounding segments in synchronism with the rotation thereof is generated through the agency of a cam 61. Cam 61 is rotated by a main drive system, not shown. Cam 61 is coupled to a spring biased actuating lever 62 via a cam follower/roller 63, the cam follower 63 being held in contact against cam 61 by means of a spring 64. Lever 62, at the end thereof which is disposed oppositely with respect to cam follower 63, is provided with a pivoted support bearing 65. The above-mentioned actuating rod 66 extends through bearing 65, a first end of rod 66 being pivotally coupled to a first end of lever 56 as described above. The second end of actuating rod 66 is provided with an adjustable stop which is indicated generally at 68. A compression spring 67 extends between stop 68 and support bearing 65. The degree of compression of spring 67 may be selected by means of the adjustable stop 68 to thereby vary the pressure which the rounding segments exert on the sides of the book block.

The cross member 48, and thus the rounding segments, is moved between upper and lower limits in response to the motion of a further lever 69. Lever 69 is, intermediate its ends, rotatably mounted in the machine frame 52. A follower roller 73 is mounted on a first end of lever 69 and is engaged in a circular cam groove 74 provided in cam 61. The lever 69 is coupled to the cross member 48 at a point disposed on the opposite side of the pivot axis of lever 69 with respect to roller 73 by means of a coupling rod 75. In order to adjust the rounding stroke which is executed by the rounding segments, the point at which coupling rod 75 acts on lever 69, the coupling rod engaging an elongated slot 76 in lever 69, is manually adjusted via an adjustment mechanism 77.

In order to superimpose the vertical movements and rotation of the rounding segments, the rotation for performing the rolling operation on the book block side surfaces is derived from the vertical movement of the rounding segments. Thus, bevel gears 78, 78', mounted from cross member 48 via a common shaft 79, engage the bevel gears 51, 51' which are affixed to the bearing axles 49, 49'. As noted above, the axles 49, 49' extend from the vertically movable support members 43, 43'. A pull rod 70 is pivotally coupled between the lower end of the guide member 44 at a projecting portion of the actuating lever 47, lever 47 being connected at a first end to the pressure lever 46 as described above.

During the variation of the spacing between the rounding segments, the bevel gear 78' is movable relative to gear 78. This movement is permitted by providing a spline connection, indicated at 80, between gear 78' and shaft 79'. Also, during variation of the spacing between the rounding segments, relative movement between the cross member 48 and axle 49 is permitted by providing a slot 81 in cross member 48, axle 49 extending through slot 81.

The point at which the pull rod 70 is pivotally coupled to the actuating lever 47 may also be varied in order to permit the utilization of different rounding radii. This variation is permitted by providing an elongated hole 50 in lever 47 and employing a sliding-block adjustment device 72 to move the end of rod 70 relative to the pivot axis of lever 47.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for rounding the spines of book blocks, the rounding apparatus serially receiving book blocks to be shaped from a transport system having book block clamps, said rounding apparatus comprising:

oppositely disposed rounding elements for engaging and acting on the opposite sides of a book block upon the release of the book block from a transport system clamp, said rounding elements each being provided with two shaped working segments which define book contacting zones on a face of the rounding element, each of said zones having a different radius whereby a book block engaged by said rounding elements may selectively be formed to a pre-selected rounding curve shape commensurate with one of said zone radii;

means for imparting motion relative to the book block to said rounding elements; and means for biasing said rounding elements against the sides of the book block during the motion thereof.

2. The apparatus of claim 1 wherein said means for imparting motion to said rounding elements includes means for causing said rounding elements to move toward and away from one another to thereby clamp or release a book block, said toward and away movement causing means including a cam, a clamp actuation member, means for coupling said cam to said clamp actuation lever, an actuating rod, means coupling said clamp actuation lever to said actuating rod, a clamp control lever, said actuating rod being connected to said clamp control lever, said clamp control lever having a first end portion and an oppositely disposed second end portion, a first guide member for defining the path of movement of a first of said rounding elements in a direction generally transverse to said toward and away movement, means for pivotally coupling said first end portion of said clamp control lever first end portion to said first guide member a second guide member for defining the path of movement of the second of said rounding elements in a direction generally transverse to said toward and away movement, means for connnecting said second guide member to said clamp control lever second end portion, said second guide member connecting means comprising an adjusting spindle and an internally threaded member which is rotatably mounted in said clamp control lever.

3. The apparatus of claim 2 wherein said means for coupling said clamp actuation lever to said actuating rod comprises a compression spring whereby a spring force is applied to said rounding elements via said guide members and said actuating rod, said clamp actuation lever coupling means further comprising means for adjusting said spring force.

4. The apparatus of claim 1 wherein said motion imparting means causes said rounding elements to execute repeated rolling movements on the sides of the book block said repeated rolling movements being produced by causing said rounding elements to move linearly relative to the book block, said rounding elements rotating during said linear motion.

5. The apparatus of claim 1 wherein said rounding element working segments are provided on the same face of each of said rounding elements.

6. The apparatus of claim 5 wherein said working segments face one another in mirror-image fashion.

7. The apparatus of claim 5 wherein said rounding elements each have in integral gear segment with a pitch circle corresponding to a mean rounding radius, and wherein said means for imparting motion to said rounding elements includes a pair of translatable intermediate frames, a toothed racks being provided on each of said frames, said gear segments meshing with respective of said toothed racks said rounding elements each further being provided with a rear-located roller supported on said intermediate frames for cooperation with respective of said cams, said means for imparting motion to said rounding elements further including actuating means for moving said rounding elements vertically said actuating means acting on the side of said rounding elements which face away from said gear segments, said gear segments executing rolling movements on said toothed racks, said intermediate frames being mounted in a supporting frame in a manner allowing horizontal translation thereof whereby said intermediate frames can be driven so as to execute opposing movements in coordination with the vertical movement of said rounding elements, and means for imparting said opposing movements to said intermediate frames, said opposing movement imparting means comprising a slotted link, and means for causing said link and means for causing said link to rotate in alternating directions, and wherein said means for imparting motion to said rounding elements additionally includes means for moving said intermediate frames with said rounding elements to a functionally effective position on the book block, with application of pressure, and to a position retracted from the book block.

8. The apparatus of claim 5 wherein said motion imparting means causes said rounding elements to simultaneously rotate and move linearly to thereby cause the rounding elements to execute rolling movements along the sides of the book block, the relative motion being superimposed on the rotation.

9. The apparatus or claim 1 wherein said motion imparting means causes said rounding elements to simultaneously rotate and move linearly relative to the book block to there by cause the rounding elements to execute rolling movements along the sides of the book block, the relative motion being superimposed on the rotation, and wherein the rounding zone radius employed for the rounding operation is selected by controlling said rolling motion.

10. The apparatus of claim 9 wherein two of said rounding elements are provided on each side of the book block, and wherein said motion imparting means causes a book contacting zone on each rounding element on each side of the book block to be brought into functional contact with the sides of the book block in an alternating manner.

11. The apparatus of claim 10 wherein the alternating movements of said rounding elements are controlled in a manner such that, co-operating pairwise, said rounding elements keep the book block continuously clamped.

12. The apparatus of claim 11 wherein said rounding elements each have an integral gear segment with a pitch circle corresponding to a mean rounding radius, and wherein said means for imparting motion to said rounding elements includes a pair of translatable intermediate frames, a toothed racks being provided on each of said frames, said gear segments meshing with respective of said toothed racks said rounding elements each further being provided with a rear-located roller supported on said intermediate frames for cooperation with respective of said cams, said means for imparting motion to said rounding elements further including actuating means for moving said rounding elements vertically said actuating means acting on the side of said rounding elements which face away from said gear segments, said gear segments executing rolling movements on said toothed racks, said intermediate frames being mounted in a supporting frame in a manner allowing horizontal translation thereof whereby said intermediate frames can be driven so as to execute opposing movements in coordination with the vertical movement of said rounding elements, and means for imparting said opposing movements to said intermediate frames, said opposing movement imparting means comprising a slotted link, and means for causing said link and means for causing said link to rotate in alternating directions, and wherein said means for imparting motion to said rounding elements additionally includes means for moving said intermediate frames with said rounding elements to a functionally effective position on the book block, with application of pressure, and to a position retracted from the book block.

13. Apparatus for rounding the spines of book blocks, the rounding apparatus serially receiving book blocks to be shaped from a transport system having book block clamps, said rounding apparatus comprising:

a pair of oppositely disposed rounding elements for engaging and acting on the opposite sides of a book block upon the release of the book block from a transport system clamp, said rounding elements each being provided with at least a pair of shaped working segments which define book contacting zones on a face of the rounding element, each of said zones having a different shape whereby a book block engaged by said rounding elements may selectively be formed to a pre-selected rounding curve shape commensurate with one of said zone shapes, said rounding element segments being provided on the same face of each rounding element, two of said rounding elements being provided on each side of the book block;

means for simultaneously imparting rotation and substantially linear motion relative to the book block to said rounding elements to thereby cause said rounding elements to execute rolling movements along the sides of the book block, the relative motion being superimposed on the rotation, said motion imparting means causing a book contacting zone on each said rounding element on each side of the book block to be brought into functional contact with the sides of the book block in an alternating manner; and means for biasing said rounding elements against the sides of the book block during the rolling movement thereof.

14. Apparatus for rounding the spines of book blocks, the rounding apparatus serially receiving book blocks to be shaped from a transport system having book block clamps, said rounding apparatus comprising:

a pair of oppositely disposed rounding elements for engaging and acting on the opposite sides of a book block upon release of the book block from a transport system clamp, said rounding elements each being provided with at least a pair of shaped working segments which define book contacting zones on a face of the rounding element, each of said zones having a different shape whereby a book block engaged by said rounding elements may selectively be formed to a pre-selected rounding curve shape commensurate with one of said zone shapes, said rounding elements each being comprised of a pair of book block contacting members, the first of said members defining a first of said zone shapes on an outer surface thereof, the second of said members defining the second of said zone shapes on an outer surface thereof, an inner surface of said first member being disposed oppositely to the said outer surface thereof and being complementary in shape to the outer surface of said second member, said first member being removably mounted over said second member when the selected rounding curve shape is commensurate with said first of said zone shapes;

means for imparting motion relative to the book block to said rounding elements; and means for biasing said rounding elements against the sides of the book block during the motion thereof.

15. The apparatus of claim 14 wherein the alternating movements of the rounding elements are controlled in a manner such that, co-operating pairwise, said rounding elements keep the book block continuously clamped.

16. The apparatus of claim 14 wherein said first and second zone shapes are arcs of circles of different radii.

17. The apparatus of claim 14 wherein said motion imparting means causes said rounding elements to simultaneously rotate and move linearly to thereby cause the rounding elements to execute rolling movements along the sides of the book block, the relative motion being superimposed on the rotation.

18. The apparatus of claim 17 wherein said means for imparting rotation and linear motion to said rounding elements comprises:

support members for said rounding elements, said rounding elements being rotatably mounted on said support members, said support members being movable in planes which are generally parallel to the sides of the book block;

guide means for controlling the motion of said support members;

a cross member interconnecting said support members whereby said support members will move as a unit; and actuating means for producing movement of said cross member to thereby cause movement of said support members on said guide means, said actuating means including actuating levers rotatably coupled to said cross member, said actuating means further including pressure levers for pivotally coupling said actuating levers to said rounding elements; and means for connecting at least a first of said actuating levers to a point which is fixed in relation to the path of motion of the transport system clamps.

19. The apparatus of claim 18 wherein said actuating means further comprises a drive lever, a coupling rod connecting said drive lever to said cross member, said coupling rod being pivotally coupled to said drive lever at a point intermediate the length of said drive lever, and means for adjusting the point at which said coupling rod is pivotably coupled to said drive lever.

20. The apparatus of claim 19 further comprising means for adjusting the point at which said connecting means is coupled to said first actuating lever to thereby select the rounding zone shape.

21. The apparatus of claim 20 wherein the movements for actuating the rounding elements are transmitted from one side of the book block to the other via bevel gear assemblies and wherein said rounding elements are coupled to said bevel gears via a drive shaft having a mechanically positive connection allowing free slidability in the axial direction, an elongated hole being provided in said crossmember in order to allow transverse slidable displacement of said supporting members and guide members on said crossmember.

22. The apparatus of claim 18 wherein said connecting means is pivotally coupled to said actuating lever and wherein said apparatus further comprises means for adjusting the point at which said connecting means is pivotally coupled to said actuating lever to thereby select the rounding element member which is to cooperate with the book block.

23. The apparatus of claim 18 wherein the movements for actuating the rounding segments are transmitted from one side of the book block to the other via bevel gear assemblies and wherein said rounding elements are coupled to said bevel gears via a drive shaft having a mechanically positive connection allowing free slidability in the axial direction, an elongated hole being provided in said crossmember in order to allow transverse slidable displacement of said supporting members and guide members on said crossmember.

* * * * *